US006675773B1

(12) United States Patent
Mahr et al.

(10) Patent No.: US 6,675,773 B1
(45) Date of Patent: Jan. 13, 2004

(54) METHOD AND APPARATUS FOR PERFORMING A FUEL INJECTION

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 110 days.

(21) Appl. No.: 09/807,880

(22) PCT Filed: Aug. 2, 2000

(86) PCT No.: PCT/DE00/02576

§ 371 (c)(1),
(2), (4) Date: Jul. 27, 2001

(87) PCT Pub. No.: WO01/14726

PCT Pub. Date: Mar. 1, 2001

(30) Foreign Application Priority Data

Aug. 20, 1999 (DE) ..... 199 39 428

(51) Int. Cl.[7] ..... F02M 41/00
(52) U.S. Cl. ..... 123/446; 123/456
(58) Field of Search ..... 123/467, 447, 123/456, 446, 502, 497; 239/88, 87

(56) References Cited

U.S. PATENT DOCUMENTS 4,069,800 A * 1/1978 Kanda et al. ..... 123/447
4,280,464 A * 7/1981 Kanai et al. ..... 123/447
4,333,436 A * 6/1982 Kopse et al. ..... 123/502
4,440,132 A * 4/1984 Terada et al. ..... 123/446
4,459,959 A * 7/1984 Terada et al. ..... 123/446
5,355,856 A * 10/1994 Paul et al. ..... 123/446
5,423,484 A * 6/1995 Zuo ..... 239/90
5,497,750 A * 3/1996 Mueller et al. ..... 123/446
5,622,152 A * 4/1997 Ishida ..... 123/446
5,878,720 A * 3/1999 Anderson et al. ..... 123/496
6,453,875 B1 * 9/2002 Mahr et al. ..... 123/446

FOREIGN PATENT DOCUMENTS

| | | |
|---|---|---|
| DE | 19716221 | * 10/1998 |
| EP | 0056916 | * 8/1982 |
| GB | 2320523 | * 6/1998 |

* cited by examiner

*Primary Examiner*—Mahmoud Gimie
(74) *Attorney, Agent, or Firm*—Ronald E. Greigg

(57) ABSTRACT

A fuel injection is effected by means of a high-pressure pump (2) and a pressure reservoir chamber (6) for generating and storing a first system pressure. This system pressure is not used for injection; instead, by means of the pressure booster unit (9), a higher injection pressure is generated during the injection, and this injection pressure can be reduced to shape the course of injection. By means of this invention, an improved capability of metering the fuel injection and an improved execution of fast switching times are achieved.

20 Claims, 9 Drawing Sheets

METHOD AND APPARATUS FOR PERFORMING A FUEL INJECTION

CROSS REFERENCE TO RELATED APPLICATIONS

This application is a 35 USC 371 application of PCT/DE 00102576 filed on Aug. 2, 2000.

BACKGROUND OF THE INVENTION

1. Field of the Invention

The invention relates to an improved method of and an apparatus for performing a fuel injection into an internal combustion engine.

2. Description of the Prior Art

For better comprehension of the description and the claims, several terms will be defined below: The fuel injection according to the invention can be performed under stroke control or pressure control. Within the scope of the invention, the term stroke-controlled fuel injection is understood to mean that the opening and closing of the injection opening is effected with the aid of a displaceable valve member on the basis of the hydraulic cooperation of the fuel pressures in a nozzle chamber and in a control chamber. A pressure reduction inside the control chamber causes a stroke of the valve member. Alternatively, the deflection of the valve member can be effected by a final control element (actuator). In a pressure-controlled fuel injection according to the invention, by means of the fuel pressure prevailing in the nozzle chamber of an injector the valve member is moved counter to the action of a closing force (spring), so that the injection opening is uncovered for an injection of the fuel out of the nozzle chamber into the cylinder. The pressure at which fuel emerges from the nozzle chamber into a cylinder of an internal combustion engine is called the injection pressure, while the term system pressure is understood to mean the pressure at which fuel is available or stored inside the fuel injection system. Fuel metering means furnishing a defined fuel quantity for injection. Leakage is understood to mean a quantity of fuel that occurs in operation of the fuel injection system (such as a guide leakage), is not used for injection, and is pumped back to the fuel tank. The pressure level of this leakage can have a standing pressure, and subsequently the fuel is pressure-relieved to the pressure level of the fuel tank.

A stroke-controlled injection has already been disclosed by German Patent Disclosure DE 196 19 523 A1. The attainable injection pressure is limited here by the pressure reservoir chamber (rail) and the high-pressure pump to approximately 1600 to 1800 bar.

To elevate the injection pressure, a pressure booster unit is possible, of the kind known for instance from U.S. Pat. No. 5,143,291 or U.S. Pat. No. 5,522,545. The disadvantage of these known pressure-boosted systems resides in a lack of flexibility of injection and poor quantity tolerance in the metering of small fuel quantities.

In a fuel injection system described in Japanese Patent Disclosure JP 08277762 A, two pressure reservoir chambers with different pressures are provided for the sake of increasing the flexibility of injection and the metering accuracy of the pre-injection. These two pressure reservoir chambers require major engineering effort and high production costs, and yet the maximum injection pressure is still limited by the fuel pump and the pressure reservoir chamber.

SUMMARY OF THE INVENTION

For better metering capability of the injection and execution of fast switching times, according to the invention, an improved method of and apparatus for pre-injection and post-injection at a lesser injection pressure than the main injection can be performed replicably. A high Injection pressure at a low pressure in the central pressure reservoir chamber can be achieved. The high-pressure generation in the fuel takes place directly in the region of the injection (metering), so that the efficiency is increased as a consequence of a smaller high-pressure volume. The use of motor oil to trigger the pressure booster unit in one embodiment assures increased safety and reliability in the performance of the method. In another embodiment, the injection pressure can be generated hydraulically, while the portion generated mechanically by means of a high-pressure pump is stored in the pressure reservoir chamber and is not used for the injection. Because of the low pressure, the load on the high-pressure pump is reduced, since this pump is not used to fill the pressure reservoir chamber, but only for the injection per se.

BRIEF DESCRIPTION OF THE DRAWINGS

Other features and advantages will be apparent from the description contained below, taken with the drawings, in which.

DESCRIPTION OF THE PREFERRED EMBODIMENTS

Figure 1:
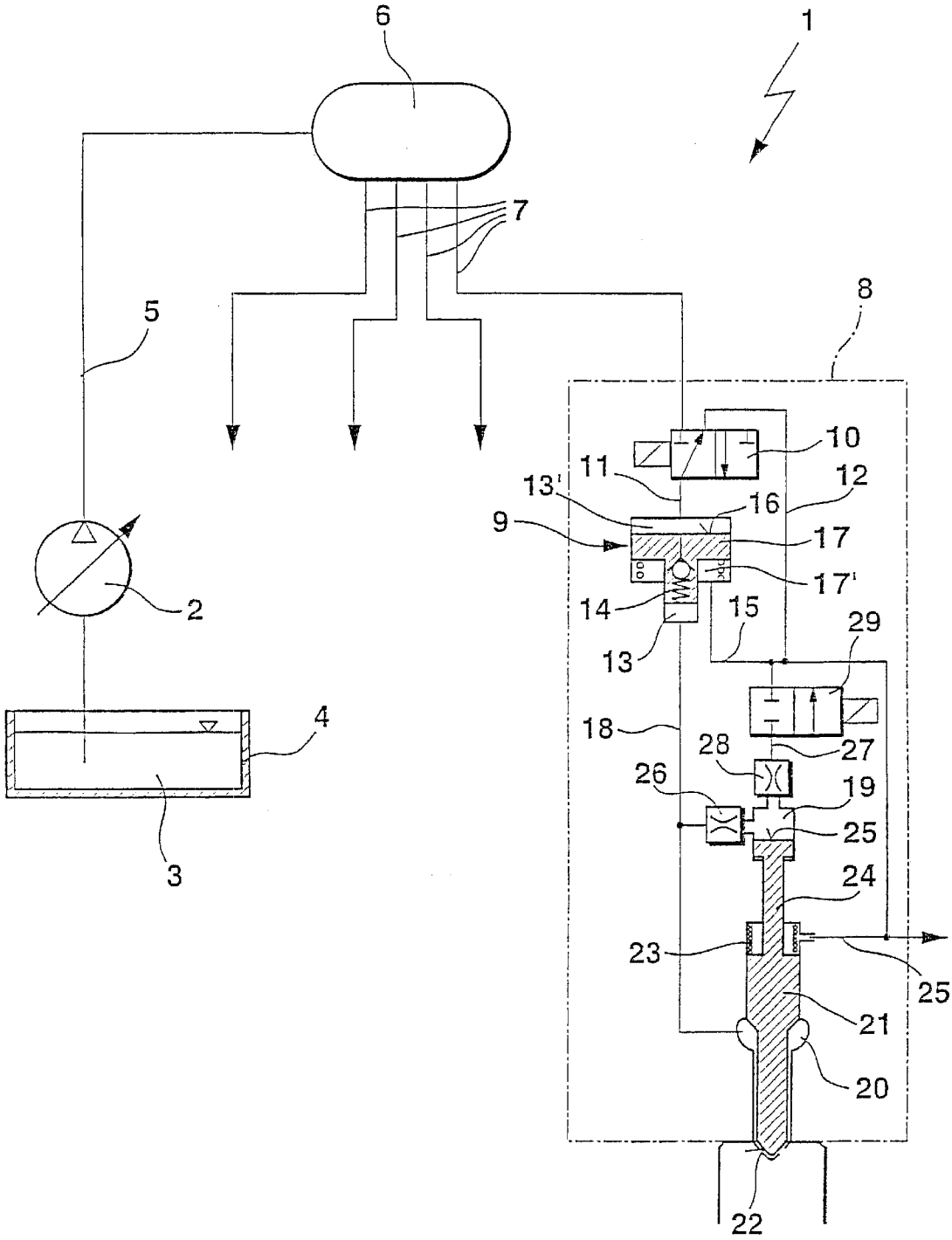
FIG. 1 is a schematic view of a first stroke-controlled fuel injection system.

In the first exemplary embodiment, shown in FIG. 1, of a fuel injection system 1, a quantity controlled fuel pump 2 pumps fuel 3 out of a tank 4 via a feed line 5 into a central pressure reservoir chamber 6 (common rail). From the pressure reservoir chamber 6, a plurality of pressure lines 7 corresponding in number to the number of individual cylinders of an internal combustion engine to be supplied lead away to the individual injectors 8. Inside each of the injectors 8 (injection devices) protruding into the combustion chamber of the engine—in FIG. 1, only one of the injectors 8 is shown—, there is a pressure booster unit 9. The pressure line 11 can be connected with the aid of a valve unit 10 for triggering the pressure boosting (3/2-way valve) to the pressure line 7, or can be made to communicate with a leakage line 12 A system pressure of approximately 200 bar to 1000 bar, which is further boosted by the pressure booster unit 9, can be stored in the pressure reservoir chamber 6.

The pressure means 17 can be subjected to pressure at one end with the aid of the valve unit 10 and the pressure line 7.

A differential chamber 171 is pressure-relieved by means of the leakage line 15, so that the pressure means 17 can be displaced to reduce the volume of a pressure chamber 13. The pressure means 17 is moved in the compression direction, so that fuel compressed in the pressure chamber 13 (first injection pressure) can be delivered to a control chamber 19 and a nozzle chamber 20. A check valve 14 prevents the return flow of compressed fuel into the pressure reservoir chamber 6. By means of a suitable ratio of the areas in a primary chamber 13' and the pressure chamber 13, a second, higher pressure can be generated in this way. If the primary chamber 13', with the aid of the valve unit 10, is connected to the leakage line 12, then the restoration of the pressure means 17 and the refilling of the pressure chamber 13 take place. Because of the pressure ratios in the pressure chamber 13 and the primary chamber 13', the check valve 14 opens, so that the pressure chamber 13 is at rail pressure (pressure of the pressure reservoir chamber 6), and the pressure means 17 hydraulically one or more springs can be disposed in the chambers 13, 13' and 17'.

By throttling inside one of the valves 10 or 29, an injection pressure that is variable during the injection and thus a shaping of the course of injection can be achieved by means of a cross-sectional control; the pressure in the control chamber 19 is varied when the cross section of the valve 29 is controlled, and thus throttling of the injection pressure is attained at the valve sealing face 22 via the valve member 21. To achieve a continuous cross-sectional control, both piezoelectric actuators and high-speed magnet actuators are conceivable. By providing multi-stage valves, instead of a continuous shaping of the injection pressure, a plurality of different injection pressure levels during injection can be created by means of different throttle positions.

In pressure line 18 communicating with the pressure chamber 13, a pressure builds up that also prevails in the control chamber 19 and the nozzle chamber 20. The injection takes place via fuel metering with the aid of a pistonlike valve member 21 that is axially displaceable in a guide bore and that has a conical valve sealing face 22 on one end, with which it cooperates with a valve seat face on the injector housing of the injector unit 8. Injection openings are provided at the valve seat face of the injector housing.

Inside the nozzle chamber 20, a pressure face pointing in the opening direction of the valve member 21 is exposed to the pressure prevailing there, which is delivered to the nozzle chamber 20 via the pressure line 18. Coaxially to a valve spring 23, a pressure piece 24 also engages the valve member 21 and with its face end 25 remote from the valve sealing face 22, the pressure piece defines the control chamber 19. From the fuel pressure connection stub, the control chamber 19 has an inlet with a first throttle 26 and an outlet to a pressure relief line 27 with a second throttle 28, which is controlled by a 2/2-way valve 29.

The nozzle chamber 20 continues across an annular gap between the valve member 21 and the guide bore, up to the valve seat face of the injector housing. By way of the pressure in the control chamber 19, the pressure piece 24 is subjected to pressure in the closing direction.

Upon actuation (opening) of the 2/2-way valve 29, the pressure in the control chamber 19 can be reduced, so that a consequence the pressure force in the nozzle chamber 20, exerted in the opening direction on the valve member 21, exceeds the pressure force exerted on the valve member 20 in the closing direction. The valve sealing face 22 lifts from the valve seat face, and fuel is injected. The pressure relief of the control chamber 19 and thus the stroke control of the valve member 21 can be varied by way of the dimensioning of the throttle 26 and the throttle 28.

The end of injection is initiated by re-actuation (closure) of the 2/2-way valve 29, which decouples the control chamber 19 from the pressure relief line 27 again, so that once again a pressure that can move the pressure piece 24 in the closing direction builds up in the control chamber 19.

The valve units are actuated for opening or closing or switching over by electromagnets. The electromagnets are triggered by a control unit, which is capable of monitoring and processing various operating parameters (engine rpm, etc.) of the engine to be supplied.

In place of the magnet-controlled valve units, piezoelectric final control elements (actuators) can also be used, which have a requisite temperature equalization and optionally a requisite force or travel boost.

Below, in the description of FIGS. 2–8, only differences from the fuel injection system of FIG. 1 will be addressed. Identical components will not be explained in detail.

Figure 2:
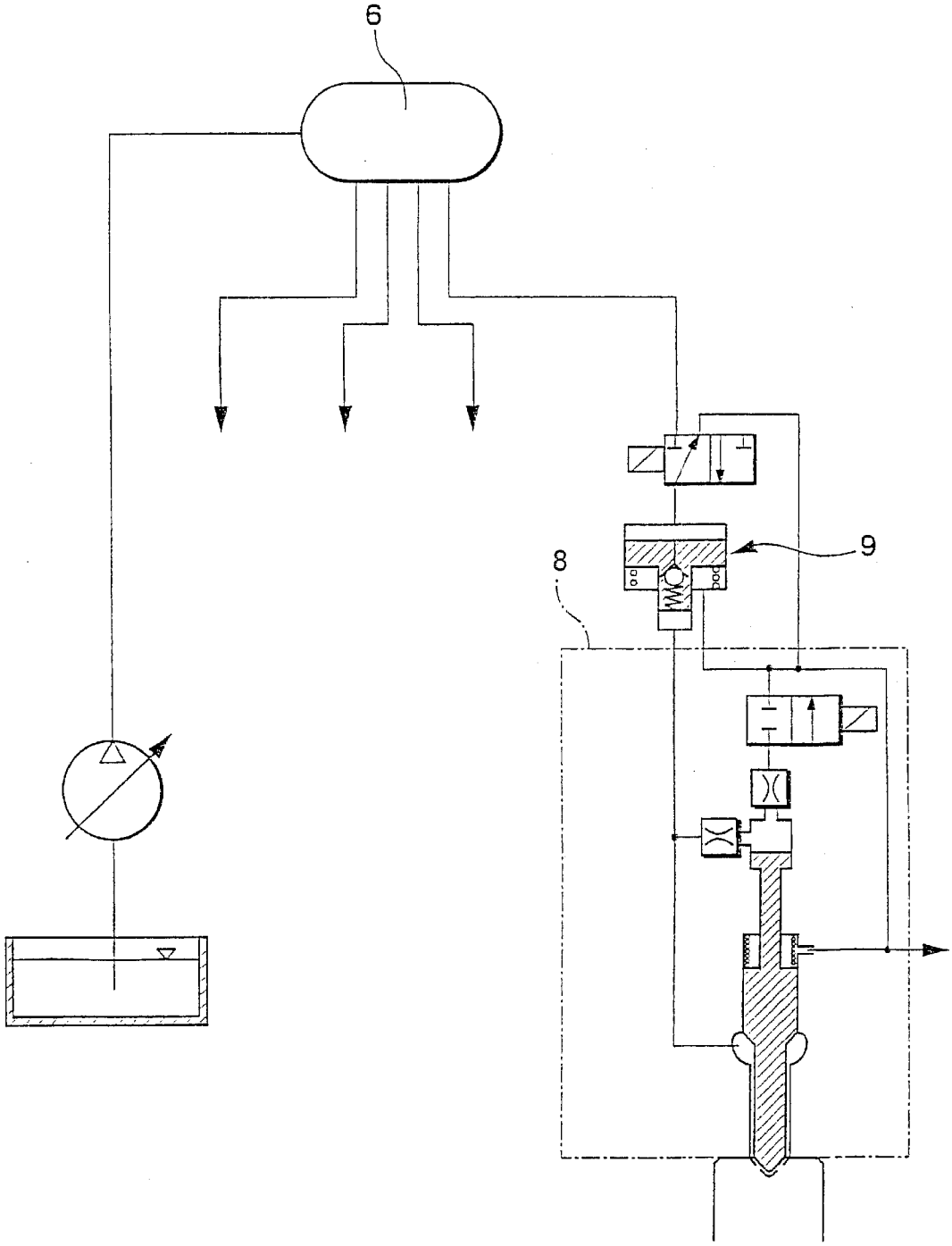
FIG. 2 schematically illustrates a second stroke-controlled fuel injection system

From FIG. 2, it can be seen that in a modification of the fuel injection system 1, the pressure booster unit 9 is disposed outside the injector 8 and is now in the region of the pressure reservoir chamber 6. The structural size of the injector 8 is reduced. The valve 10 can be disposed on the pressure reservoir chamber, and the pressure booster unit can be disposed on the injector.

Figure 3:
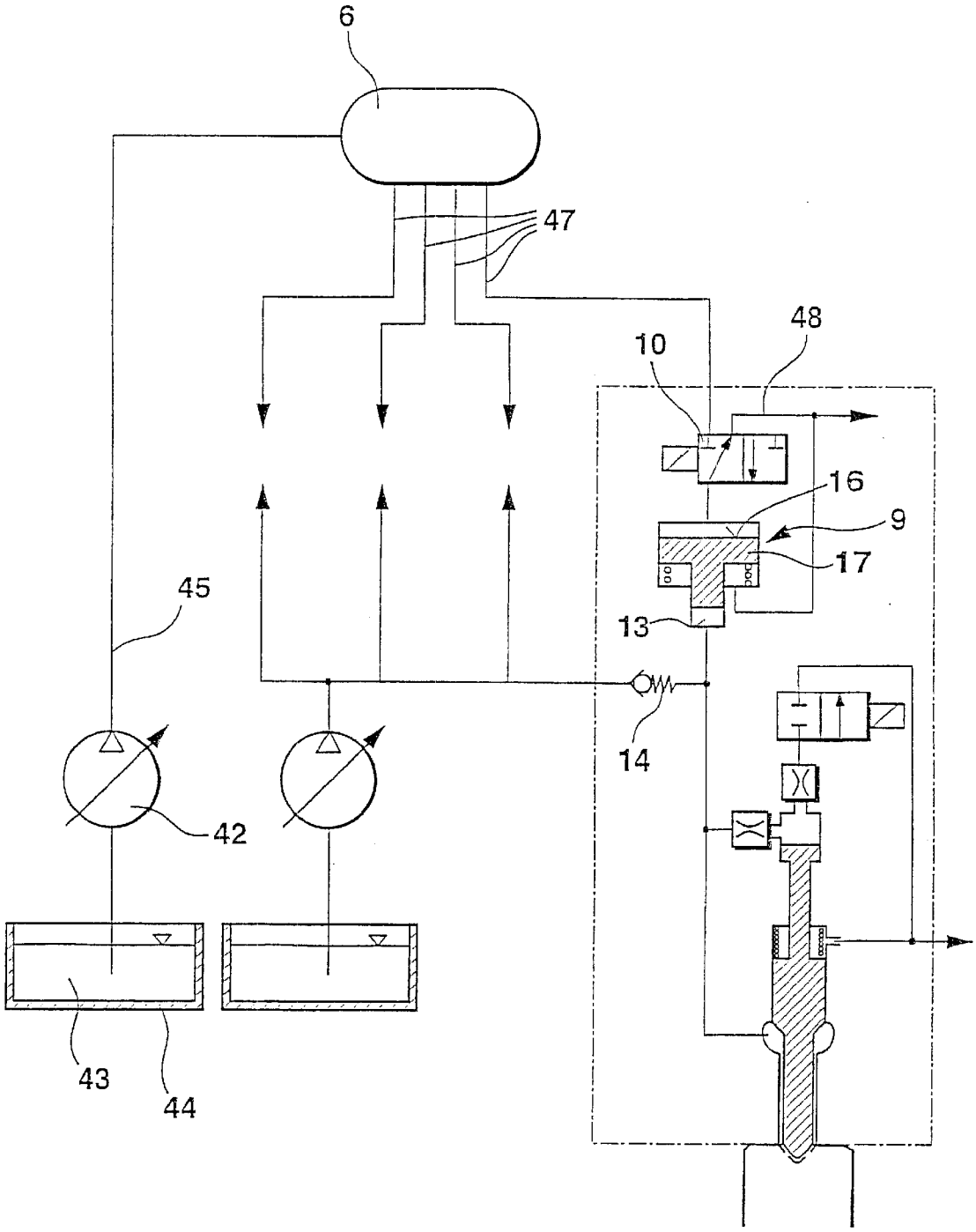
FIG. 3 illustrates a third stroke-controlled fuel injection system, using a separate pressure fluid.

In the fuel injection system of FIG. 3, the pressure reservoir chamber 6 is filled with motor oil or some other suitable pressure fluid 43 from a supply container 44 via the feed line 45 and the pump 42, in order to trigger the pressure booster unit 9. The low-pressure side 16 of the pressure means 17 can either be subjected to pressure via the pressure line 47, or connected to a leakage line 48. The switchover is attainable by means of the 3/2-way valve 10.

The pressure chamber 13 can be filled with fuel from a further supply container via the check valve 14, or with the aid of a prefeed pump—as shown—this can be done at a lesser prefeed pressure. The injection takes place as described for FIG. 1.

Figure 4:
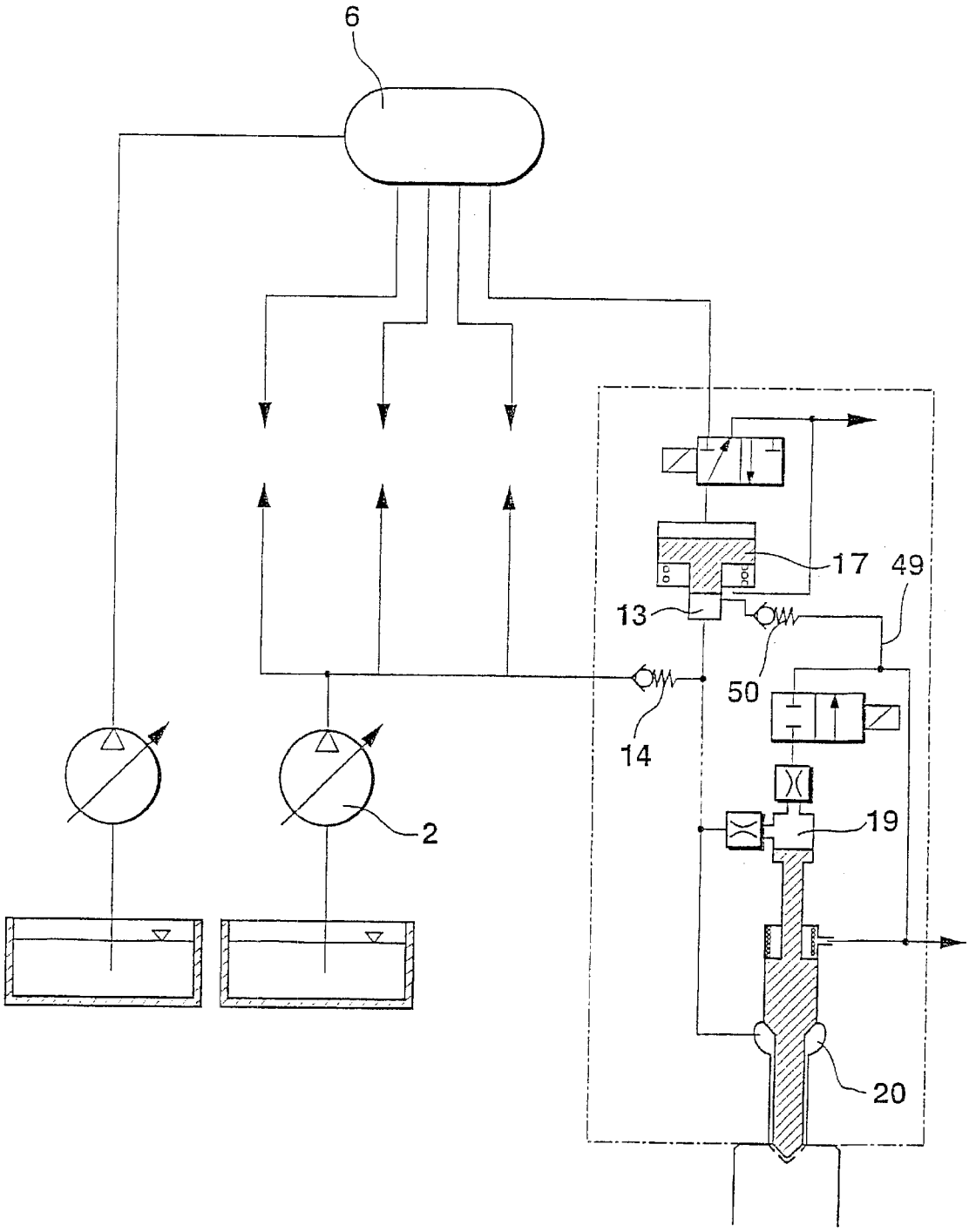
FIG. 4 illustrates a fourth stroke-controlled fuel injection system, using a pressure limitation in the pressure booster unit.

Alternatively to throttling the fuel in the region of the fuel metering, the second system pressure can be generated using a pressure limiting valve in the form of a check valve 50 in the region of the pressure booster unit (FIG. 4). The check valve 50 opens at a pressure of approximately 300 bar. The pressure chamber 13 is filled with fuel from a supply container via the check valve 14, with the aid of a fuel pump. In this case, at a short stroke of the pressure means 17, which initially is in its returned position and is then moved in the direction of the bottom of the pressure chamber 13, the pressure chamber 13 remains in communication with the check valve 50, so that the pressure in the pressure chamber 13 is limited to 300 bar, so that fuel at this pressure can be carried to the nozzle chamber 20 and the control chamber 19. The check valve 14 prevents the return flow of compressed fuel in the direction of the fuel pump 2.

At a longer stroke of the pressure means 17 as a consequence of the imposition of pressure on the pressure means 17 with a fluid from the pressure reservoir chamber 6, the access of the pressure chamber 13 to the leakage line 49 is closed, so that a higher injection pressure is attained. In the main injection, a so-called "boot injection" can thus be performed, along with a pre-injection at low pressure.

Figure 5:
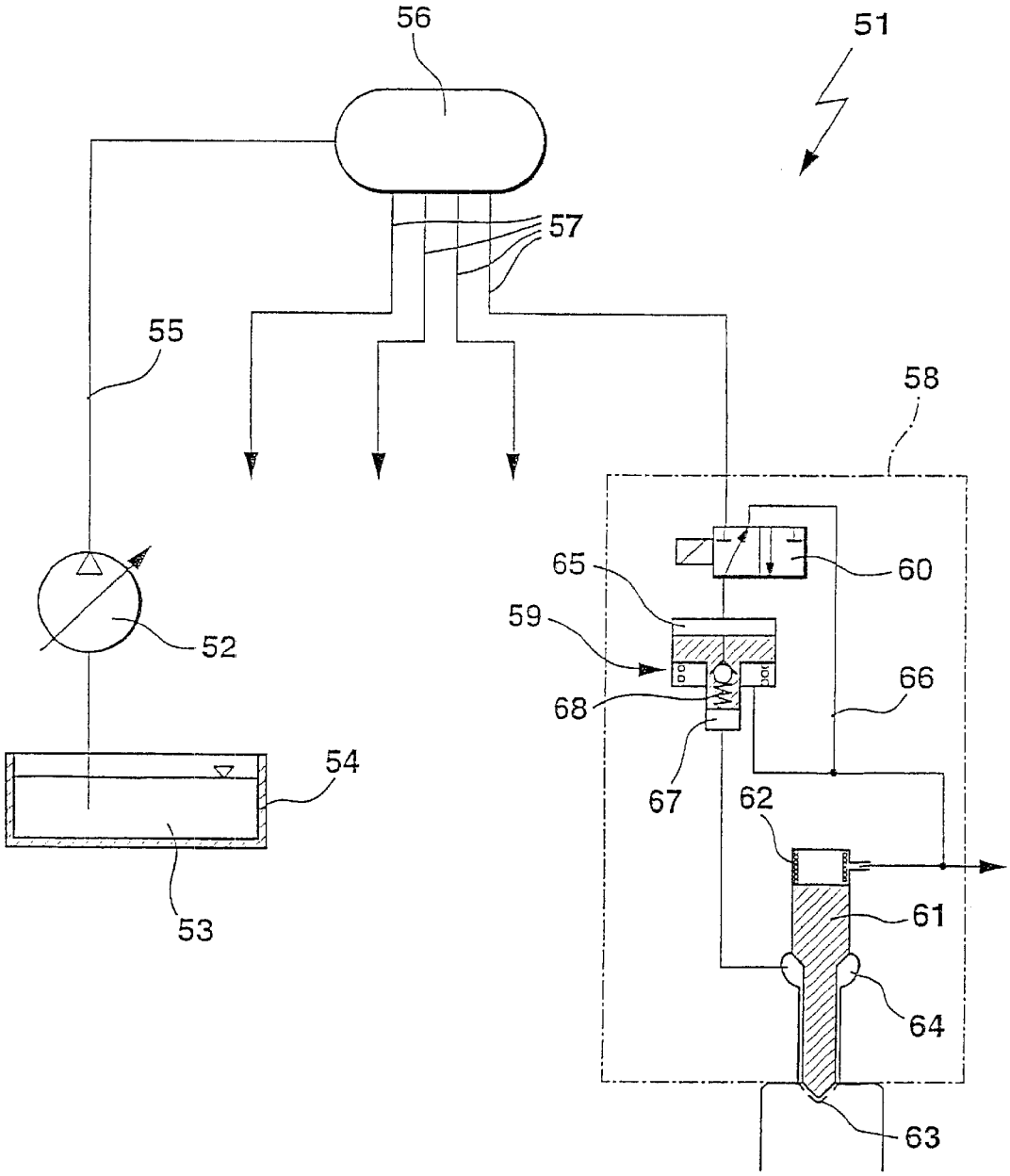
FIG. 5 illustrates a first pressure-controlled fuel injection system.

In a modification of the above exemplary embodiments, a pressure-controlled fuel injection system 51 is shown in FIG. 5. Once again, a high-pressure pump 52 pumps fuel 53 out of a supply container 54 via a feed line 55 into a pressure reservoir chamber 56, which stores the fuel 53 at a pressure of 300 to 800 bar and which communicates with individual injectors 58 via individual pressure lines 57. From the pressure reservoir chamber 56, the injection pressure of each injector 58 is generated by means of a respective pressure booster unit 59 disposed inside each injector 58. By means of a valve unit 60 (3/2-way valve), the injection is done under pressure control. A valve member 61 can move, counter to the closing force of a compression spring 62, away from the valve seat face 63 of the injector housing when a nozzle chamber 64 is filled with fuel at a suitable pressure. In the currentless state of the valve unit 60, the pressure booster unit 59 is connected to a leakage line 66. A pressure chamber 67 can be filled via a check valve 68.

By means of a continuous cross-sectional control of the valve 60, shaping of the course of injection (as in FIG. 1) can be attained. If multi-stage valves are used, it is likewise possible to attain various injection pressure levels by means of different throttle positions. Once again, piezoelectric actuators or magnet actuators are conceivable as actuators.

Figure 6:
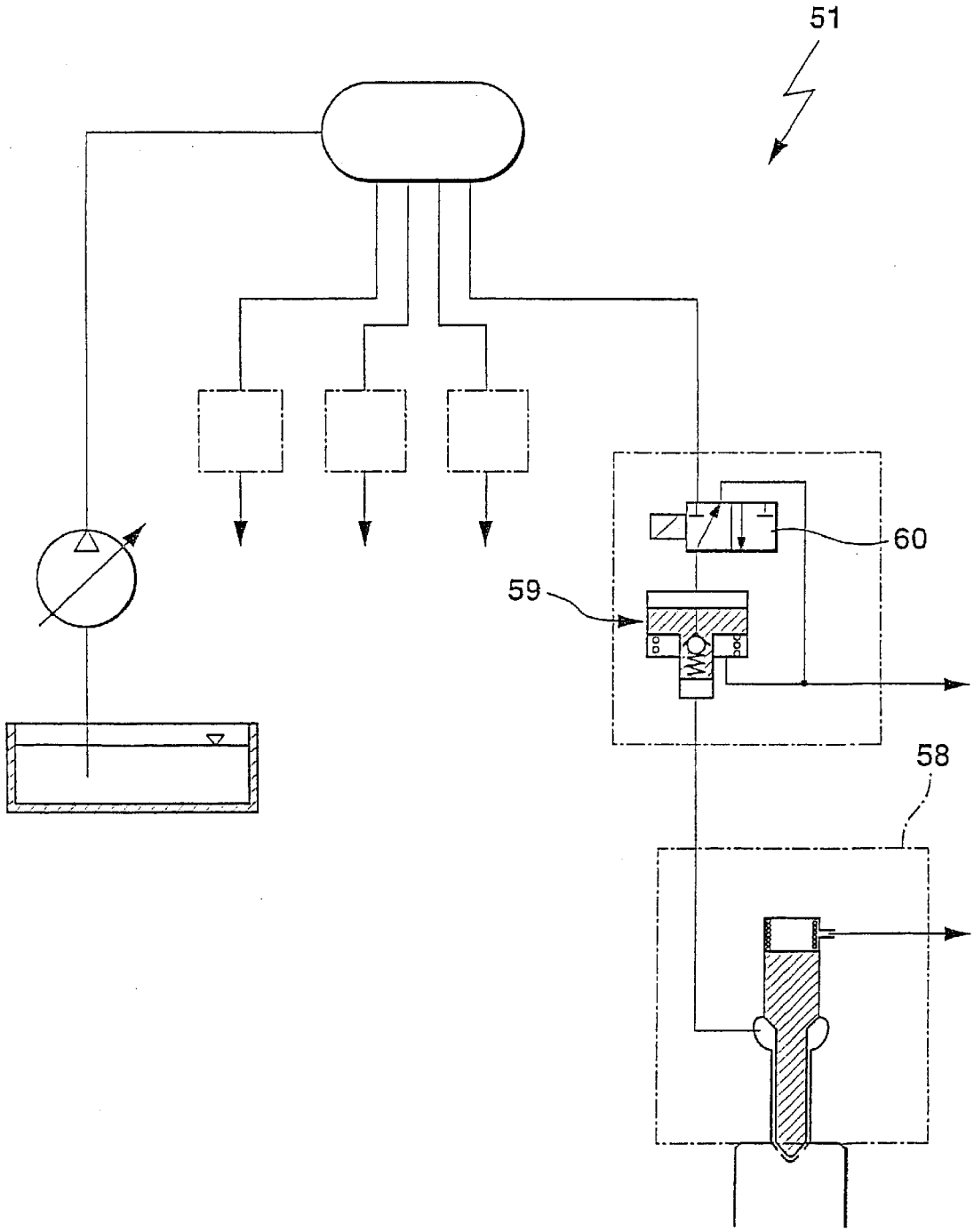
FIG. 6 illustrates a second pressure-controlled fuel injection system.

In FIG. 6, the pressure booster unit 59 and the valve unit 60 in a pressure-controlled fuel injection system 51 are located outside the injector 58, in the region of the pressure reservoir chamber 56.

Figure 7:
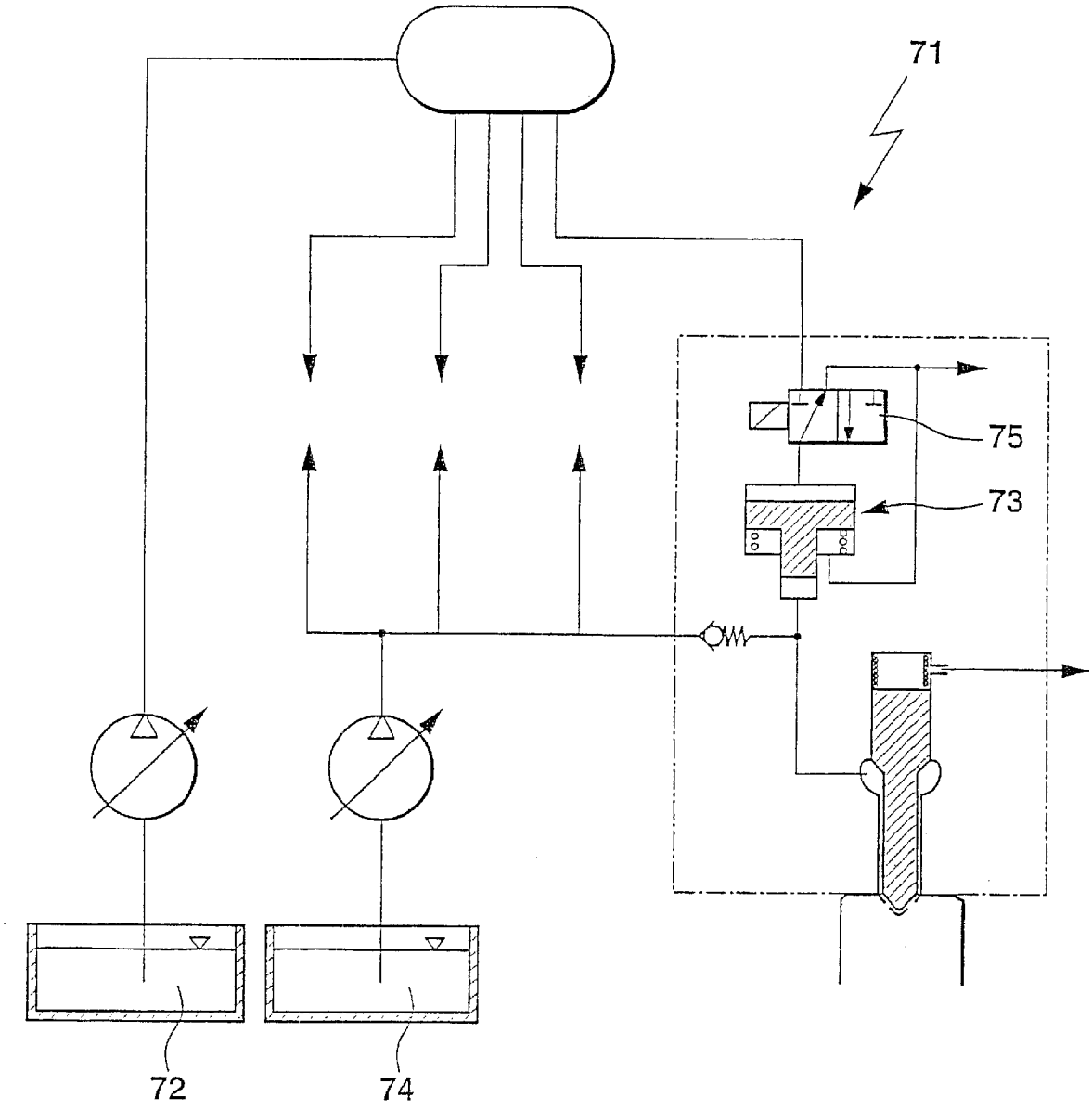
FIG. 7 illustrates a third pressure-controlled fuel injection system, using a separate pressure fluid.

In the exemplary embodiment of a pressure-controlled fuel injection system 71 in FIG. 7, the generation and boosting of the pressure of fuel 74 delivered from a supply container are achieves with a motor oil as the pressure fluid 72. The pressure booster unit 73 acts as a coupling element between the fuel delivery and the pressure fluid delivery system. A second system pressure is attained via throttling inside a valve cross section of a valve unit 75 (see the description of FIGS. 1–6 as well).

Figure 8:
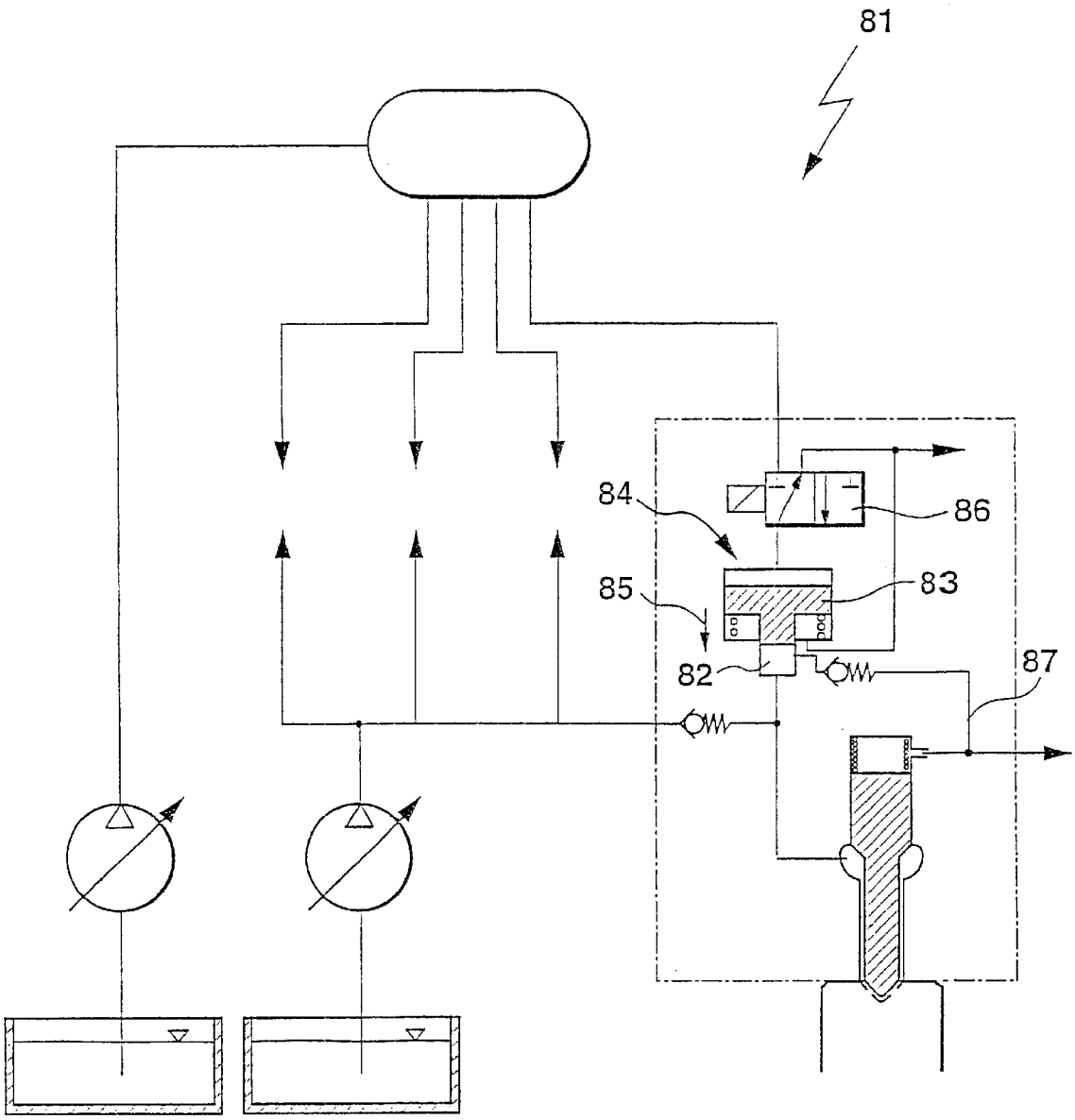
FIG. 8 illustrates a fourth pressure-controlled fuel injection system, using a pressure limitation in the pressure booster unit.

FIG. 8 shows a pressure-controlled fuel injection system 81 which employs a pressure limitation of the fuel compressed In the pressure chamber 82 (see also the analogous stroke-controlled variant in FIG. 4). At a short stroke of the pressure means 83, the pressure in the pressure chamber 82 of the pressure booster unit 84 is limited to approximately 300 bar, since the pressure chamber 82 communicates with a leakage line 87 via a pressure limiting check valve. Upon further motion of the pressure means 83 in the direction of the arrow 85, this pressure limitation path is closed, and the full injection pressure is generated.

This makes a pre-injection at low pressure possible by means of a separate actuation of a valve unit 86. In a main injection, a boot injection can additionally be generated. The valve unit 86 can be reinforced or triggered directly or hydraulically (control piston and control chamber) by means of magnet actuators (in the event of throttling in the region of the valve seat face, a travel control of the magnet valve must be provided). By the use of a piezoelectric actuator, shaping of the course of injection (a boot injection) in the main injection can also be achieved. This is equally applicable to all the embodiments of the invention.

Figure 9:
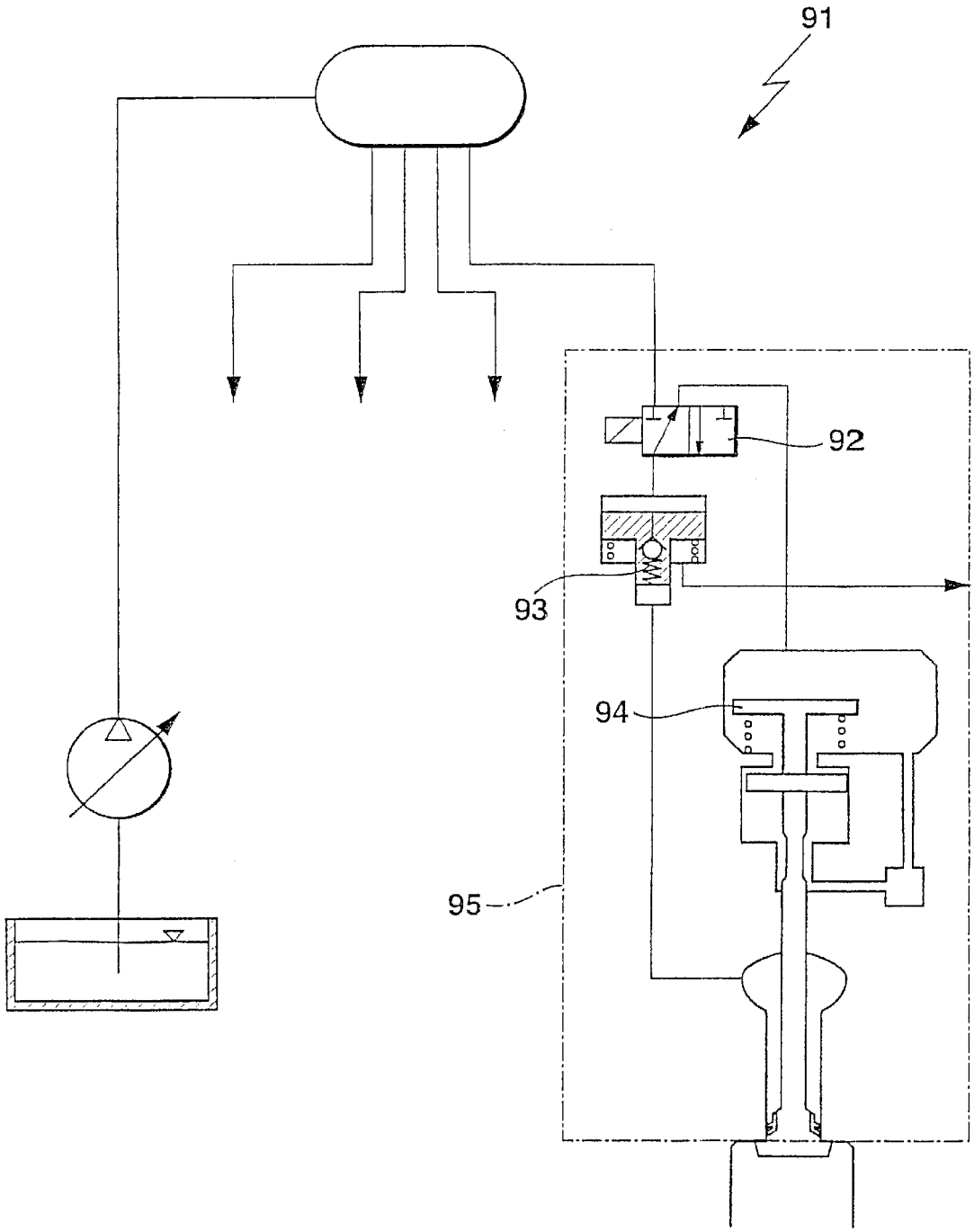
FIG. 9, a fifth pressure-controlled fuel injection system with a variable injection nozzle.

FIG. 9 pertains to a pressure-controlled fuel injection system 91 with an injection nozzle that is modified compared to the exemplary embodiments shown above. Once again, via a fuel pump, fuel or alternatively motor oil is pumped into a pressure reservoir chamber at a pressure of approximately 300 to approximately 300 bar. Beginning at this pressure reservoir chamber, the Injection pressure is generated locally for each cylinder via a pressure booster unit. If motor oil is used as the fluid, the pressure booster unit also acts as a coupler. Via a 3/2-way valve 92 with a cross-sectional control or a piezoelectric actuator, the injection is achieved under pressure control. In the currentless state, the low-pressure side of the pressure booster unit is connected to leaking oil and can be filled via a check valve 93. By means of throttling in the valve seat of the valve 92, a second injection pressure can be developed. Instead of the blind bore or seat bore nozzles shown in the above drawings, a vario-nozzle or vario-register nozzle is used. The opening cross section of the nozzle holes that is available is variable. The course of injection can be adapted still better to the requirements of the engine. In the case of a vario-register nozzle, a plurality of rows of nozzle holes can be opened in stages. The triggering for the hydraulic stroke stop 94 of the nozzle can be done both inside the injector 95 and also centrally for all the injectors simultaneously.

The foregoing relates preferred exemplary embodiments of the invention, it being understood that other variants and embodiments thereof are possible within the spirit and scope of the invention, the latter being defined by the appended claims.

We claim:

1. In a method for performing a fuel injection with a high-pressure pump (2; 52) and a pressure reservoir chamber (6; 56) for generating and storing a first system pressure, the improvement wherein this system pressure is not used for injection, but instead, by means of a pressure booster unit (9; 59; 73; 84), a higher injection pressure is generated during the injection, and the injection pressure can be reduced to shape the course of injection.

2. The method of claim 1, wherein the shaping of the injection pressure is generated by means of a controllable valve cross section.

3. The method of claim 1, wherein the shaping of the injection pressure is generated by means of diversion via a pressure limiting valve (50) or a deflection piston.

4. The method of claim 2, wherein the pressure booster unit (9; 59; 73; 84) is disposed at an arbitrary point between the pressure reservoir chamber (6; 56) and a nozzle chamber (20; 64) of an injector (8; 58).

5. The method of claim 4, wherein the pressure booster unit (9; 59; 73; 84) is integrated with the injector (8; 58; 95).

6. The method of claim 4, wherein the pressure booster unit (9; 59; 73; 84) is disposed on the pressure reservoir chamber (6; 56) or is integrated with the pressure reservoir chamber (6; 56).

7. The method of claim 1, wherein, as pressure fluid (43; 72) for operating the pressure booster unit (9; 73), a medium other than fuel is used, preferably a motor oil.

8. The method of claim 1, wherein the fuel injection is performed with stroke control.

9. The method of claim 1, wherein the fuel injection is performed with pressure control.

10. An apparatus for performing the method of claim 1.

11. The apparatus of claim 10, characterized in that the pressure booster unit is disposed on the injector and the control valve is disposed on the pressure reservoir chamber.

12. The method of claim 3, wherein the pressure booster unit (9; 59; 73; 84) is disposed at an arbitrary point between the pressure reservoir chamber (6; 56) and a nozzle chamber (20; 64) of an injector (8; 58).

13. The method of claim 12, wherein the pressure booster unit (9; 59; 73; 84) is integrated with the injector (8; 58; 95).

14. The method of claim 12, wherein the pressure booster unit (9; 59; 73; 84) is disposed on the pressure reservoir chamber (6; 56) or is integrated with the pressure reservoir chamber (6; 56).

15. The method of claim 2 wherein, as pressure fluid (43; 72) for operating the pressure booster unit (9; 73), a medium other than fuel is used, preferably a motor oil.

16. The method of claim 3 wherein, as pressure fluid (43; 72) for operating the pressure booster unit (9; 73), a medium other than fuel is used, preferably a motor oil.

17. The method of claim 4 wherein, as pressure fluid (43; 72) for operating the pressure booster unit (9; 73), a medium other than fuel is used, preferably a motor oil.

18. The method of claim 2, wherein the fuel injection is performed with stroke control.

19. The method of claim 2, characterized in that the fuel injection is performed with pressure control.

20. In a method for performing a fuel injection with a high-pressure pump (2; 52) and a pressure reservoir chamber (6; 56) for generating and storing a first system pressure, the method comprising the steps of generating, by means of a pressure booster unit (9; 59; 73; 84), an injection pressure which is higher than the system pressure, and reducing the higher injection pressure by means which shape the course of injection.

* * * * *